United States Patent [19]

Holmberg

[11] Patent Number: 4,530,527

[45] Date of Patent: Jul. 23, 1985

[54] CONNECTION OF DRILL TUBES

[75] Inventor: John M. Holmberg, Ascot, England

[73] Assignee: Boart International Limited, Johannesburg, South Africa

[21] Appl. No.: 420,160

[22] Filed: Sep. 20, 1982

[30] Foreign Application Priority Data

Sep. 21, 1981 [ZA] South Africa ..... 81/6533

[51] Int. Cl.[3] ..... F16L 13/14

[52] U.S. Cl. ..... 285/382.4; 285/390; 285/397; 29/523

[58] Field of Search ..... 285/382.4, 382.5, 92, 285/370, 397, 355, 390, DIG. 7; 29/523

[56] References Cited

U.S. PATENT DOCUMENTS

| | | | |
|---|---|---|---|
| 214,881 | 4/1879 | Cain | 285/382.4 |
| 806,156 | 12/1905 | Marshall | 285/355 X |
| 1,281,977 | 10/1918 | Kelley | 285/92 |
| 1,682,635 | 8/1928 | Smith | 285/382.4 X |
| 2,346,051 | 4/1944 | Seamark | 285/DIG. 7 X |
| 2,429,076 | 10/1947 | Sery | 285/390 X |
| 2,793,059 | 5/1927 | Woodling | 285/355 X |
| 4,128,264 | 12/1978 | Oldford | 285/382.4 X |
| 4,411,456 | 10/1983 | Martin | 285/382.4 X |

FOREIGN PATENT DOCUMENTS

| | | |
|---|---|---|
| 1137310 | 12/1968 | United Kingdom . |
| 1265715 | 3/1972 | United Kingdom . |

*Primary Examiner*—Dave W. Arola
*Attorney, Agent, or Firm*—Ladas & Parry

[57] ABSTRACT

The invention provides a method of joining two rigid tubes such as are used in drill stems wherein a nipple internal to the tubes is threaded and screws into at least one of the tubes, the nipple provided with a zone of reduced internal diameter which registers with a cavity in the internal bore of the tube and the zone of reduced internal diameter expanded outwards into contact with the tube to occupy the registering cavity in the tube and form a positive lock against tensile forces.

6 Claims, 4 Drawing Figures

CONNECTION OF DRILL TUBES

BACKGROUND OF THE INVENTION

This invention relates to the connection of one rigid tube such as a hollow drill stem to another by means of a threaded nipple or coupling. Assemblies of a string of connected drill stems or tubes of this kind are commonly used in circumstances where the task of adding to the drill string to increase its length is difficult and where it is desirable to ensure that the connection, once made is not accidentally negated.

It is often convenient where drill tubes are concerned to provide a joint which is suitable for transmitting axial as well as torsional loads without increasing the external diameter of the tubes at the joint, while still providing for a core to be extracted, if so desired, within the string of tubes.

United Kingdom Pat. Nos. 1,137,310 and 1,265,715 describe joints which meet the above-mentioned objectives but also entail certain disadvantages. Pat. No. 1,265,715 discloses one rod screwed into the end of another to form the joint. This join requires special forging of the male section and there is no disclosure of any means to prevent the rods from unscrewing when the drill string is rotated. In Pat. No. 1,137,310 a tapering male/female joint is swaged and brazed along the interface. The tubes are of different malleability. However, this process will not give a rigid joint suitable for the transmission of large torsional forces. In addition, the taper of the interface will reduce the resistance of the joint to axial forces tending to pull the tubes apart. Neither of these patents disclose the use of a connector or nipple.

It is an object of the invention to overcome or mitigate the above problems.

SUMMARY OF THE INVENTION

According to the invention a method of forming a joint of high strength between two tubes of substantially similar high rigidity by means of a nipple which is no greater in external cross-section than the external cross-section of the tubes comprising forming on one end of the nipple a zone in which the internal diameter is reduced substantially relatively to the remainder of that part of the nipple intended to enter the tube, forming a zone of substantially enlarged inner diameter in a first tube to register with the reduced zone of the nipple, introducing the nipple into that tube, expanding the material of the nipple in the reduced zone radially outwards into contact with the tube to occupy the registering cavity in the tube and form a positive lock against tensile forces, and connecting the nipple to the second tube.

If it is desired that the nipple be permanently connected at each end to a drill tube, the arrangement mentioned above can be provided at each end.

The step of enlarging the reduced zone of the nipple can be undertaken by the use of any suitable tool such as a roll or a mandrel rammed down the interior of the nipple.

In some versions the nipple may have a boss in its central zone which defines a shoulder against which the end of the drill tube bears when the nipple is in its final position. In other versions the nipple is free of such a boss and the drill tubes bear on each other end-to-end in the assembled string.

The invention also includes a nipple as described above for use in making the connection.

DESCRIPTION OF PREFERRED EMBODIMENTS

Figure 1:
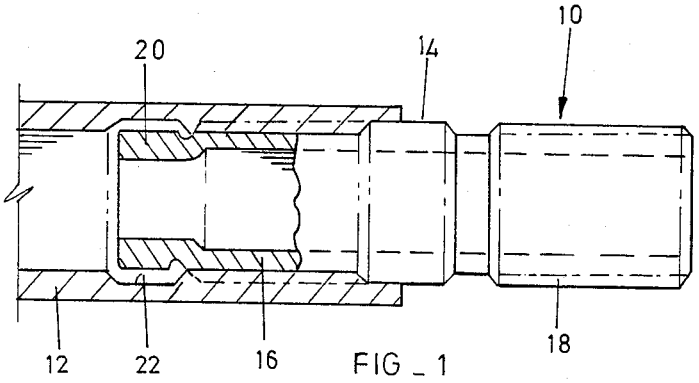
FIG. 1 is a semi-schematic view of a threaded nipple, partly sectioned, inserted at one end into a drill tube.
Figure 2:
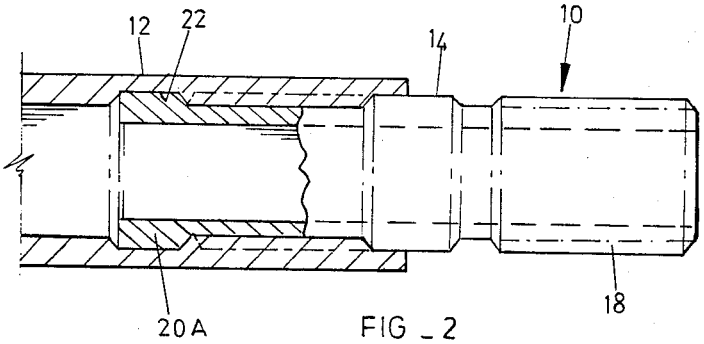
FIG. 2 is a view of the structure of FIG. 1 after the step of expanding the reduced zone of the nipple into contact with the drill tube.

In FIGS. 1 and 2, a nipple or coupling 10 for connecting two drill tubes 12 in a drill string has a plain central zone 14, a threaded left end 16 accommodated in a threaded end of the tube 12, and a threaded right end 18. The far left end of the nipple forms a zone 20 of reduced internal diameter which registers with an annular cavity or groove 22 in a zone of the tube 12.

Once the nipple 10 is fully inserted into the tube 12 as shown, a mandrel (not shown) is rammed down the interior of the nipple to expand the metal in the zone 20 into contact with the surface of the cavity 22 as seen in FIG. 2. In this condition the expanded zone 20A has an internal diameter substantially equal to that of the rest of the nipple, so that the tube interior can be used in the usual fashion for core extraction or for flushing fluid or the like. The diameter of the mandrel will of course be slightly less than that of the bore of the nipple.

The nipple may be as illustrated in FIGS. 1 and 2 or may also have a zone in the right end corresponding to the opposite zone 20, 20A. This nipple provides a permanent connection to both drill tubes when inserted and expanded, although this is not easy in practice.

Figure 3:
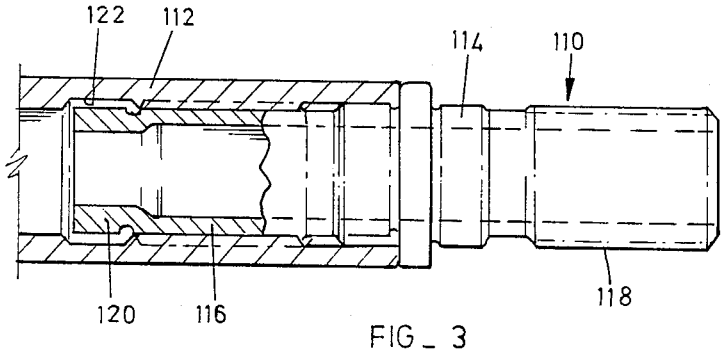
FIG. 3 is a view similar to FIG. 1 of a second embodiment in which the nipple has a central boss.
Figure 4:
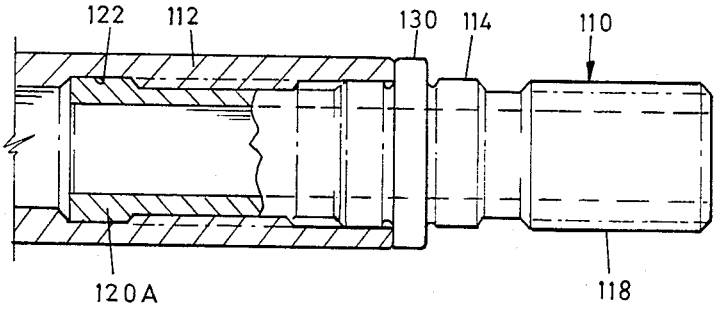
FIG. 4 is a view similar to FIG. 2 of the structure of FIG. 3.

In FIGS. 3 and 4 the structure illustrated is similar to that in FIGS. 1 and 2, corresponding features being given the same reference numerals preceded by the prefix "1". The nipple 110 has however an annular boss 130 in the centre of the zone 114, and the end of the tube 112 bears against the side of the boss 130 when the nipple is fully inserted.

One end 16 or 18 of the nipple 10 and a corresponding tube end 12 may be provided with a left-hand thread. The joint is then made so that the threads tighten when the tubes are rotated in the high-torsion rotational direction for drilling.

The present invention thus provides a means for joining rigid tubes, the joint being such that an internal hollow remains for coring if necessary. The external diameter of the string of tubes is not increased at the joints and the joint is of a high strength in resisting axial and torsional forces and bending moments. The recesses 22, 122 may be pre-formed and the only deformation which is necessary when the joint is made (often on site in difficult circumstances) is deformation of the nipple, which may be of a softer metal than the drill tubes. There is no need for welding or brazing or for the use of equipment which must surround the tubes when the joint is made.

I claim:

1. A drill tube connection which includes two drill tubes of substantially similar high rigidity and substantially equal external cross-section, the connection being capable of withstanding substantial axial and rotational drilling forces and of permitting core extraction therethrough, each drill tube having a threaded zone near its end and at least one of them having a zone of enlarged internal diameter defining an annular cavity in the vicinity of its threaded end, and a tubular nipple connecting the tubes in aligned relationship, the tubular nipple being no greater in external cross-section than the external cross-section of the tubes so that the connection is no greater in external cross-section than the tubes, the nipple having zones towards either end threaded complementarily to the threads of the end zones of the tubes, the threaded zones of the nipple being received by, and engaged with the threaded end zones of the tubes and at least one end of the nipple having a zone of enlarged outer diameter which occupies the cavity for resisting axial forces on the connection.

2. The tubes and nipple of claim 1, in which the internal diameter of the nipple is substantially constant.

3. The tubes and nipple of claim 2 in which the nipple has a zone of enlarged outer diameter at each end, these zones each occupying a corresponding cavity in a tube.

4. A method of forming a joint of high strength capable of withstanding substantial axial and rotational drilling forces between two drill tubes of substantially similar high rigidity and substantially equal external cross-section by means of an independent nipple which is no greater in external cross-section than the external cross-section of the tubes, so that the joint is no greater in external cross-section than the tubes, the method comprising the steps of forming corresponding threads on the nipple and in the tubes, forming on one end of the nipple a zone in which the internal diameter is reduced substantially relatively to the remainder of that part of the nipple intended to enter a tube, forming a zone of substantially enlarged inner diameter in a first tube to register with the reduced zone of the nipple, screwing the end of the nipple having the reduced internal diameter into the first tube, expanding the material of the nipple in the reduced diameter zone radially outwards by ramming a mandrel through the tube and nipple into contact with the tube to occupy the registering enlarged inner diameter zone of the tube to leave a passage through which a core can be extracted and form a positive lock against tensile forces, and screwing a second tube onto the other end of the nipple.

5. A method according to claim 4 including the step of providing a zone of reduced internal diameter at the second end of the nipple, providing a corresponding cavity in a registering zone of the second tube, and expanding the material of the nipple in these zones to connect the nipple to the second tube.

6. A method according to claim 5 in which the nipple is expanded by ramming a mandrel through it.

* * * * *